US008997432B2

(12) United States Patent
Gard et al.

(10) Patent No.: US 8,997,432 B2
(45) **Date of Patent: *Apr. 7, 2015**

(54) MODULAR ENTRANCE FLOOR SYSTEM

(71) Applicant: E.M.E.H., Inc., Lebanon, NJ (US)

(72) Inventors: John Leavitt Gard, Mountain View, CA (US); David E. Adams, Muncy, PA (US); Nancy Jane Perkins, Dallas, TX (US); David Ronald Bailey, Muncy, PA (US); Craig Young, Lewisburg, PA (US); Kenneth Hart, Buckinghamshire (GB); Richard P. Morris, Oakville (CA); Nathan D. Morris, Perry, GA (US)

(73) Assignee: E.M.E.H., Inc., Lebanon, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/082,957

(22) Filed: Nov. 18, 2013

(65) Prior Publication Data

US 2014/0075876 A1 Mar. 20, 2014

Related U.S. Application Data

(63) Continuation of application No. 13/611,305, filed on Sep. 12, 2012, now Pat. No. 8,601,767, which is a continuation of application No. 12/432,587, filed on Apr. 29, 2009, now Pat. No. 8,291,670.

(51) Int. Cl.

| | |
|---|---|
| ***E04F 15/02*** | (2006.01) |
| ***E04C 2/30*** | (2006.01) |
| ***E04C 2/42*** | (2006.01) |

(52) U.S. Cl.

CPC .. *E04C 2/42* (2013.01); *E04F 15/02* (2013.01)

(58) Field of Classification Search

CPC ..... E04F 15/02044; E04F 15/02161; E04F 15/02183; E04F 15/02188; E04F 15/02194; E04F 15/02417; E04F 15/02447; E04F 15/02458; E04F 15/06; E04C 2/42–2/428; E04B 5/02; A01K 1/0151

USPC ..... 52/177, 188, 662, 663, 673, 791.1, 664

See application file for complete search history.

(56) References Cited

U.S. PATENT DOCUMENTS

| | | | |
|---|---|---|---|
| 344,704 | A | 6/1886 | Whiteley |
| 400,997 | A | 4/1889 | Berrie |

(Continued)

FOREIGN PATENT DOCUMENTS

| | | |
|---|---|---|
| CN | 101111650 | 1/2008 |
| CN | 201202247 | 3/2009 |
| GB | 2076868 | 12/1981 |

OTHER PUBLICATIONS

U.S. Appl. No. 29/480,645, filed Jan. 28, 2014.

(Continued)

*Primary Examiner* — Christine T Cajilig

(74) *Attorney, Agent, or Firm* — Baker Botts L.L.P.

(57) ABSTRACT

A modular entrance floor system comprising a plurality of floor sections, the plurality of floor sections being disposed adjacent each other and defining a perimeter of an entrance floor area. Each floor section includes a base plate permanently coupled to a foundation, and a surface plate removably attached to the base plate. The surface plate has at least one drain feature. The plurality of floor sections are configured such that the surface plate of a first floor section is interchangeable with the surface plate of a second floor section, independent of the adjacent floor sections.

22 Claims, 11 Drawing Sheets

(56) References Cited

U.S. PATENT DOCUMENTS

| | | | | |
|---|---|---|---|---|
| 1,878,688 | A * | 9/1932 | Field | 52/664 |
| 2,057,171 | A | 10/1936 | Van Der Pyl | |
| 2,240,240 | A | 4/1941 | Brockman | |
| 2,503,174 | A | 4/1950 | Salvadore | |
| D165,926 | S | 2/1952 | Moor, Jr. | |
| 2,653,358 | A | 9/1953 | MacDonald | |
| 2,701,890 | A | 2/1955 | Moor, Jr. | |
| 3,046,852 | A | 7/1962 | Graham | |
| 3,236,018 | A | 2/1966 | Graham et al. | |
| 3,334,456 | A | 8/1967 | Naka | |
| 3,383,822 | A | 5/1968 | Viehmann et al. | |
| 3,396,501 | A | 8/1968 | Tate | |
| 3,470,663 | A | 10/1969 | Tate | |
| 3,555,762 | A | 1/1971 | Costanzo, Jr. | |
| 3,605,166 | A | 9/1971 | Chen | |
| 3,783,471 | A | 1/1974 | McGeary et al. | |
| 3,808,628 | A | 5/1974 | Betts | |
| 3,921,350 | A | 11/1975 | Van Schoyck | |
| 3,938,295 | A | 2/1976 | Tate | |
| 4,018,025 | A | 4/1977 | Collette | |
| 4,029,834 | A | 6/1977 | Bartlett | |
| 4,109,439 | A * | 8/1978 | Feasel | 52/667 |
| 4,167,599 | A | 9/1979 | Nissinen | |
| 4,203,268 | A | 5/1980 | Gladden, Jr. et al. | |
| 4,276,728 | A | 7/1981 | Balzer et al. | |
| 4,282,695 | A * | 8/1981 | Lew | 52/668 |
| 4,287,693 | A | 9/1981 | Collette | |
| 4,319,520 | A | 3/1982 | Lanting et al. | |
| 4,348,840 | A | 9/1982 | Strader et al. | |
| 4,381,324 | A | 4/1983 | Ellingson, Jr. | |
| 4,453,365 | A | 6/1984 | Gladden | |
| 4,478,901 | A | 10/1984 | Dickens et al. | |
| 4,561,232 | A | 12/1985 | Gladden et al. | |
| RE32,061 | E | 1/1986 | Ellingson, Jr. | |
| 4,568,587 | A | 2/1986 | Balzer | |
| 4,584,221 | A | 4/1986 | Kung | |
| 4,590,110 | A | 5/1986 | Arens | |
| 4,596,729 | A | 6/1986 | Morrison | |
| D286,575 | S | 11/1986 | Saunders | |
| 4,654,245 | A | 3/1987 | Balzer et al. | |
| 4,663,903 | A | 5/1987 | Ellingson, Jr. | |
| 4,675,222 | A | 6/1987 | Berndt, Jr. | |
| 4,766,020 | A | 8/1988 | Ellingson, Jr. | |
| 4,804,570 | A | 2/1989 | Bedics | |
| 4,835,924 | A | 6/1989 | Blacklin et al. | |
| 4,877,672 | A | 10/1989 | Shreiner | |
| 4,879,151 | A | 11/1989 | Ellingson, Jr. | |
| 4,952,434 | A | 8/1990 | Rumsey et al. | |
| 4,968,170 | A | 11/1990 | Wilson et al. | |
| 4,999,964 | A | 3/1991 | Taylor | |
| 5,054,253 | A | 10/1991 | Bedics | |
| 5,088,251 | A | 2/1992 | Hazeldine | |
| 5,103,608 | A | 4/1992 | Andreo | |
| 5,157,804 | A | 10/1992 | Williams | |
| 5,190,799 | A | 3/1993 | Ellingson, III | |
| 5,195,292 | A | 3/1993 | Bedics | |
| D337,398 | S | 7/1993 | Axelrod | |
| D343,260 | S | 1/1994 | Kovatch | |
| 5,275,502 | A | 1/1994 | Glaza et al. | |
| 5,323,575 | A | 6/1994 | Yeh | |
| 5,364,204 | A | 11/1994 | MacLeod | |
| 5,400,559 | A | 3/1995 | Nicholas | |
| 5,474,831 | A | 12/1995 | Nystrom | |
| 5,486,392 | A | 1/1996 | Green | |
| 5,499,888 | A | 3/1996 | Hawkes | |
| 5,509,244 | A * | 4/1996 | Bentzon | 52/387 |
| 5,513,472 | A | 5/1996 | Olsen et al. | |
| D374,728 | S | 10/1996 | Bielert | |
| 5,587,218 | A | 12/1996 | Betz | |
| 5,687,534 | A | 11/1997 | Kongsgaard et al. | |
| 5,695,842 | A | 12/1997 | Peck, Jr. | |
| 5,778,609 | A | 7/1998 | Pawson et al. | |
| 5,815,995 | A | 10/1998 | Adam | |
| D405,200 | S | 2/1999 | Hines | |
| 5,881,508 | A | 3/1999 | Irvine et al. | |
| D415,581 | S | 10/1999 | Bertolini | |
| 6,101,768 | A | 8/2000 | Springstead et al. | |
| D433,165 | S | 10/2000 | Moreau et al. | |
| 6,352,757 | B1 * | 3/2002 | Kessler et al. | 428/120 |
| 6,434,779 | B1 | 8/2002 | Bartlett et al. | |
| 6,539,681 | B1 | 4/2003 | Siegmund | |
| D477,883 | S | 7/2003 | Smith et al. | |
| D479,936 | S | 9/2003 | Nurmentaus | |
| 6,635,331 | B2 | 10/2003 | Kessler | |
| 6,663,937 | B2 | 12/2003 | Ullman et al. | |
| 6,695,527 | B2 | 2/2004 | Seaux et al. | |
| 6,884,489 | B2 | 4/2005 | Kessler | |
| 6,941,703 | B2 | 9/2005 | MacLean et al. | |
| 6,966,155 | B2 | 11/2005 | Nevison | |
| 7,108,902 | B2 | 9/2006 | Ellingson | |
| 7,175,899 | B2 | 2/2007 | Kessler | |
| 7,210,876 | B2 | 5/2007 | Moralez et al. | |
| 7,244,076 | B2 | 7/2007 | Whitson | |
| 7,287,356 | B2 | 10/2007 | Sacks et al. | |
| 7,303,801 | B2 | 12/2007 | Kessler | |
| 7,344,334 | B2 | 3/2008 | Thorkelson | |
| 7,444,784 | B2 | 11/2008 | Brown | |
| D616,571 | S | 5/2010 | Gard et al. | |
| D616,572 | S | 5/2010 | Gard et al. | |
| D616,573 | S | 5/2010 | Gard et al. | |
| D619,272 | S | 7/2010 | Gard et al. | |
| D620,151 | S | 7/2010 | Perkins et al. | |
| 7,846,524 | B2 | 12/2010 | Baglietto | |
| 8,291,670 | B2 | 10/2012 | Gard et al. | |
| 8,397,466 | B2 | 3/2013 | Jenkins et al. | |
| 8,409,688 | B2 | 4/2013 | Afolabi | |
| 8,414,217 | B2 * | 4/2013 | Rosan | 404/35 |
| 8,601,767 | B2 | 12/2013 | Gard et al. | |
| 2002/0139070 | A1 | 10/2002 | Berndt, Jr. | |
| 2005/0115181 | A1 | 6/2005 | Grau | |
| 2005/0170139 | A1 | 8/2005 | Kessler | |
| 2006/0070314 | A1 | 4/2006 | Jenkins et al. | |
| 2006/0260223 | A1 | 11/2006 | Wang | |
| 2007/0193133 | A1 | 8/2007 | Krupnick | |
| 2008/0104923 | A1 * | 5/2008 | Boxhorn et al. | 52/663 |
| 2008/0118703 | A1 | 5/2008 | Sansano | |
| 2008/0134593 | A1 | 6/2008 | Moller | |
| 2008/0287221 | A1 * | 11/2008 | Babinsky et al. | 473/415 |

OTHER PUBLICATIONS

U.S. Appl. No. 14/063,849, filed Oct. 25, 2013.
U.S. Appl. No. 12/432,587, filed Sep. 20, 2012 Response to Amendment under Rule 312.
U.S. Appl. No. 12/432,587, filed Sep. 12, 2012 Amendment after Notice of Allowance and Issue Fee payment.
U.S. Appl. No. 12/432,587, filed Jun. 20, 2012 Notice of Allowance.
U.S. Appl. No. 12/432,587, filed May 7, 2012 Amendment and Request for Continued Examination (RCE).
U.S. Appl. No. 12/432,587, filed Jan. 5, 2012 Final Office Action.
U.S. Appl. No. 12/432,587, filed Aug. 18, 2011 Response to Non-Final Office Action.
U.S. Appl. No. 12/432,587, filed Apr. 18, 2011 Non-Final Office Action.
U.S. Appl. No. 13/611,305, filed Oct. 17, 2013 Corrected Notice of Allowability.
U.S. Appl. No. 13/611,305, filed Sep. 30, 2013 Issue Fee payment.
U.S. Appl. No. 13/611,305, filed Jun. 28, 2013 Notice of Allowance.
U.S. Appl. No. 13/611,305, filed Jun. 11, 2013 Response to Final Office Action, Terminal Disclaimer filed and approved.
U.S. Appl. No. 13/611,305, filed Apr. 15, 2013 Final Office Action.
U.S. Appl. No. 13/611,305, filed Jan. 11, 2013 Response to Non-Final Office Action.
U.S. Appl. No. 13/611,305, filed Oct. 10, 2012 Non-Final Office Action.
U.S. Appl. No. 29/336,215, filed Apr. 12, 2010 Amendment after Notice of Allowance and Issue Fee payment.
U.S. Appl. No. 29/336,215, filed Jan. 12, 2010 Notice of Allowance.
U.S. Appl. No. 29/336,217, filed Apr. 13, 2010 Amendment after Notice of Allowance and Issue Fee payment.
U.S. Appl. No. 29/336,217, filed Jan. 13, 2010 Issue Fee payment.
U.S. Appl. No. 29/336,222, filed Jun. 15, 2010 Issue Fee payment.

(56) References Cited

OTHER PUBLICATIONS

U.S. Appl. No. 29/336,222, filed May 6, 2010 Notice of Allowance.
U.S. Appl. No. 29/336,222, filed Apr. 12, 2010 Response to Non-Final Office Action.
U.S. Appl. No. 29/336,222, filed Dec. 31, 2009 Non-Final Office Action.
U.S. Appl. No. 29/336,224, filed Apr. 12, 2010 Amendment after Notice of Allowance and Issue Fee payment.
U.S. Appl. No. 29/336,224, filed Jan. 13, 2010 Notice of Allowance.
U.S. Appl. No. 29/336,229, filed Apr. 12, 2010 Issue Fee payment.
U.S. Appl. No. 29/336,229, filed Jan. 12, 2010 Notice of Allowance.
International Search Report for PCT/US2010/026782, dated May 11, 2010.

* cited by examiner

MODULAR ENTRANCE FLOOR SYSTEM

CROSS-REFERENCE TO RELATED APPLICATIONS

This application is a continuation of application Ser. No. 12/432,587, filed Apr. 29, 2009, now U.S. Pat. No. 8,291,670, and is a continuation of application Ser. No. 13/611,305, filed Sep. 12, 2012, which are each herein incorporated by reference in their entireties.

BACKGROUND OF THE DISCLOSED SUBJECT MATTER

1. Field of the Disclosed Subject Matter

The disclosed subject matter relates to an entrance floor system for use in residential or commercial establishments. Particularly, the present disclosed subject matter is directed to a modular entrance floor system comprising a plurality of floor sections and a method for interchanging select floor sections.

2. Description of Related Art

A variety of flooring designs and construction methods are known for entrance ways to office buildings, stores, residences and the like which are frequently provided with gratings which are recessed into the foundation so as to be flush with the floor surface. These gratings are designed to facilitate the removal of debris, such as dirt, snow, water and the like from the footwear of pedestrian traffic entering the structure.

Typical forms of such entrance gratings comprise a plurality of elongated rigid rails arranged in side-by-side, parallel relationship. These rails are generally rectangular and sized to extend large distances, and in some embodiments, over the entire entrance floor area such that a single grate can span the entire entrance floor area. The size and weight of such large gratings presents numerous problems with respect to installation and maintenance as handling of such cumbersome gratings can prove hazardous and require assistance by numerous service personnel. An example of such prior art designs is disclosed in U.S. Pat. No. 5,054,253 which is hereby incorporated by reference, in its entirety.

Alternative prior art floor structures are configured as a roll-up design in which rails are joined or interconnected to adjacent rails by a flexible hinge member. Similar to the prior art designs discussed above, these roll-up mats are typically elongated rigid rails arranged parallel to each other and extend over the entire entrance floor area. Consequently, these roll-up designs are prone to the same installation and maintenance problems referred to above. An example of such a roll-up floor mat is disclosed in U.S. Pat. Nos. 4,029,834 and 4,877,672 which are hereby incorporated by reference, in their entirety.

Floor mats are also known which are directly supported by a floor surface and may either be placed directly thereon or in a slight recess. While floor mats are typically made of lighter materials and may be of a smaller size than metal gratings discussed above, such floor mats require more frequent cleaning than the previously described grill and grating systems because less space is provided for the accumulation of foreign material. The capacity of such a floor mat to accumulate foreign material is generally limited by the amounts which may be retained in the tread material. As these spaces fill with dirt or become saturated with water, the floor mat tends to lose its ability to clean the footwear of pedestrians passing across the mat. Also, the tread surfaces of such floor mats are generally not replaceable and lack the strength and durability of rigid rails.

The prior art entrance floor designs typically span an area ranging from approximately three square feet and greater. However, pedestrian traffic tends to be concentrated to a narrow strip, e.g., the strip of entrance flooring aligned with a doorway, thereby resulting in uneven usage and accumulation of debris across the entrance floor area. The prior art designs do not allow a custodian to access and/or replace only a portion of the entrance floor area. Instead, the entire floor area must be removed in order to collect the debris. Such a configuration leads to greater complexity and higher maintenance time and associated costs. Additionally, the prior art entrance floor designs may not provide sufficient free or "fall-through" area in the top surface for which debris may pass through. Thus, the top surface of the entrance floor may retain water and/or debris resulting in a slick surface which poses a safety hazard to pedestrians.

While these prior art designs have been effective for their intended purpose, there remains a need for an entrance floor system which can be custom designed to a particular size and/or shape having a modular design which allows for independent installation and removal of each floor module or section. Further, an entrance floor system which allows for a variety of surface floor features and aesthetics is desired to provide greater flexibility and customization for a variety of architectures and entrance appearances.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a modular entrance floor system comprising a plurality of floor sections. Each floor section includes a base plate having opposing first and second surfaces with a peripheral edge defined therebetween, as well as a surface plate having opposing first and second surfaces with a peripheral edge defined therebetween. The base plate can be permanently coupled to the foundation while the surface plate is removably attached to the base plate and can include at least one drain feature. When in the attached configuration, the peripheral edge of the base plate substantially coincides with the peripheral edge of the surface plate. The plurality of floor sections are configured such that the surface plate of a first floor section is interchangeable with the surface plate of a second floor section, independent of adjacent surface plates.

The first surface of the base plate can be permanently coupled to a foundation while the second surface of the base plate includes means for attaching the surface plate. Also, the base plate has a plurality of apertures extending between the first and second surfaces, and can further comprise a barrier sheet disposed between the base plate and the surface plate. The base plate is configured to receive debris from the drain feature, which can be an aperture or an elongated recess. The surface plate can further include at least one housing configured to receive at least one insert. The surface plate can also include at least one downwardly extending wall defining a gap between the surface plate and the base plate, with the downwardly extending wall including at least one opening formed therein. The sides of the floor sections are sized to be no greater than 40 inches or smaller, such as no greater than 25 inches, or no greater than 20 inches, as examples.

Additionally, the modular entrance floor system comprises a plurality of floor sections which are disposed adjacent each other and define a perimeter of an entrance floor area. Each floor section includes a circumscribing boundary defining a periphery of the floor section such that the surface plate of a select floor section disposed a distance from the perimeter of the entrance floor area is removable independent of the surface plates adjacent to the periphery of the select floor section.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE DISCLOSED SUBJECT MATTER

Figure 1:
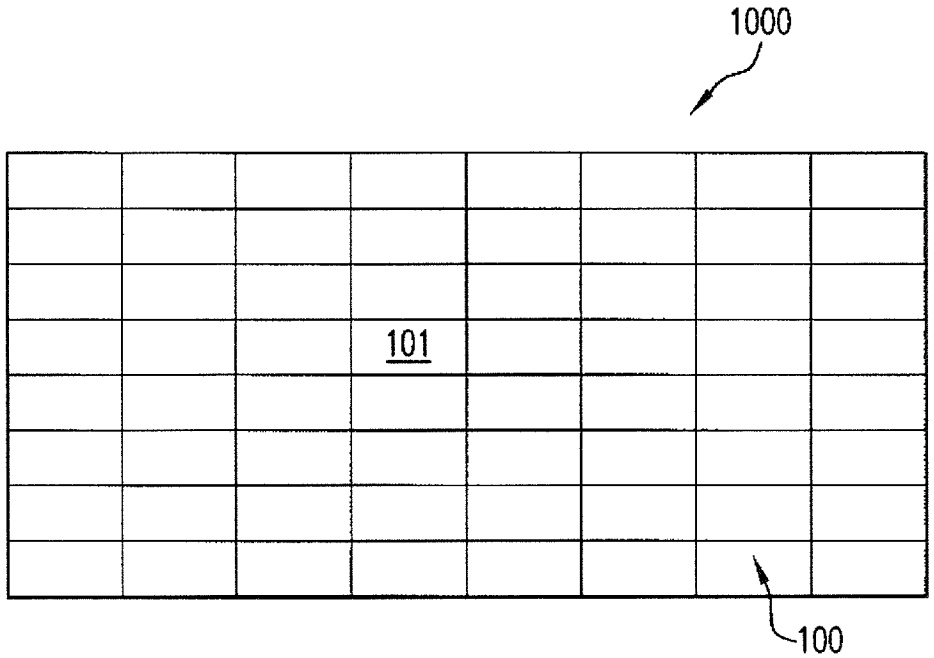
FIG. 1 is a schematic representation of an exemplary embodiment of the modular entrance floor system depicting a plurality of individual floor sections in accordance with the disclosed subject matter.

Reference will now be made in detail to the exemplary embodiments of the disclosed subject matter, examples of which are illustrated in the accompanying drawings. The methods and corresponding steps of the disclosed subject matter will be described in conjunction with the detailed description of the system. The methods and systems presented herein may be used for an entrance floor area. The disclosed subject matter is particularly suited for a modular entrance floor area having a variety of designs and aesthetic features.

In accordance with an aspect of the disclosed subject matter, a plurality of floor sections are positioned adjacent to each other to define an entrance floor area. Each individual floor section includes a base and a surface plate. The surface plate is removably attached to the base plate and can include at least one drain feature. The plurality of floor sections are configured such that the surface plate of one floor section is interchangeable with another surface plate, independent of and without removal of the other floor sections.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, an exemplary embodiment of the system in accordance with the disclosed subject matter is shown in FIGS. 1-4 and is designated generally by reference character 1000.

Figure 2:
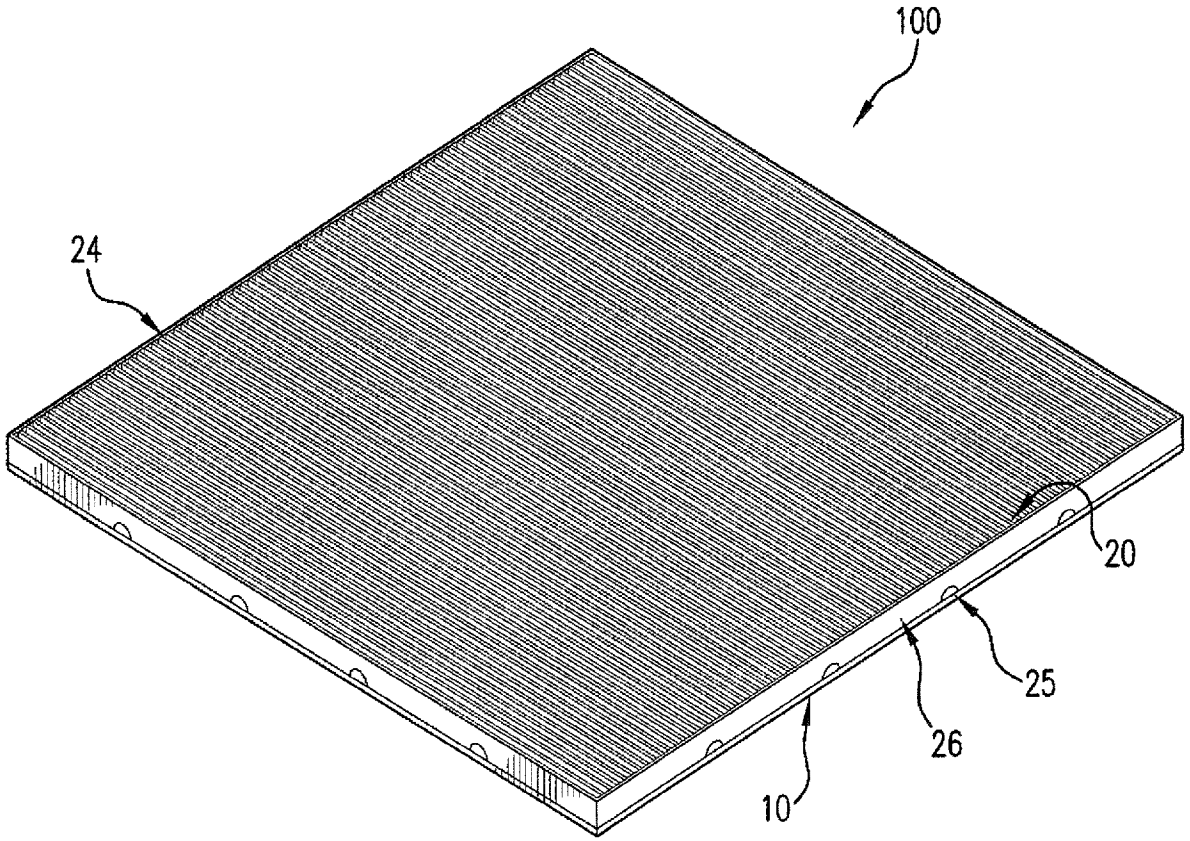
FIG. 2 is a perspective view of an individual floor section of the entrance floor area shown in FIG. 1.
Figure 3:
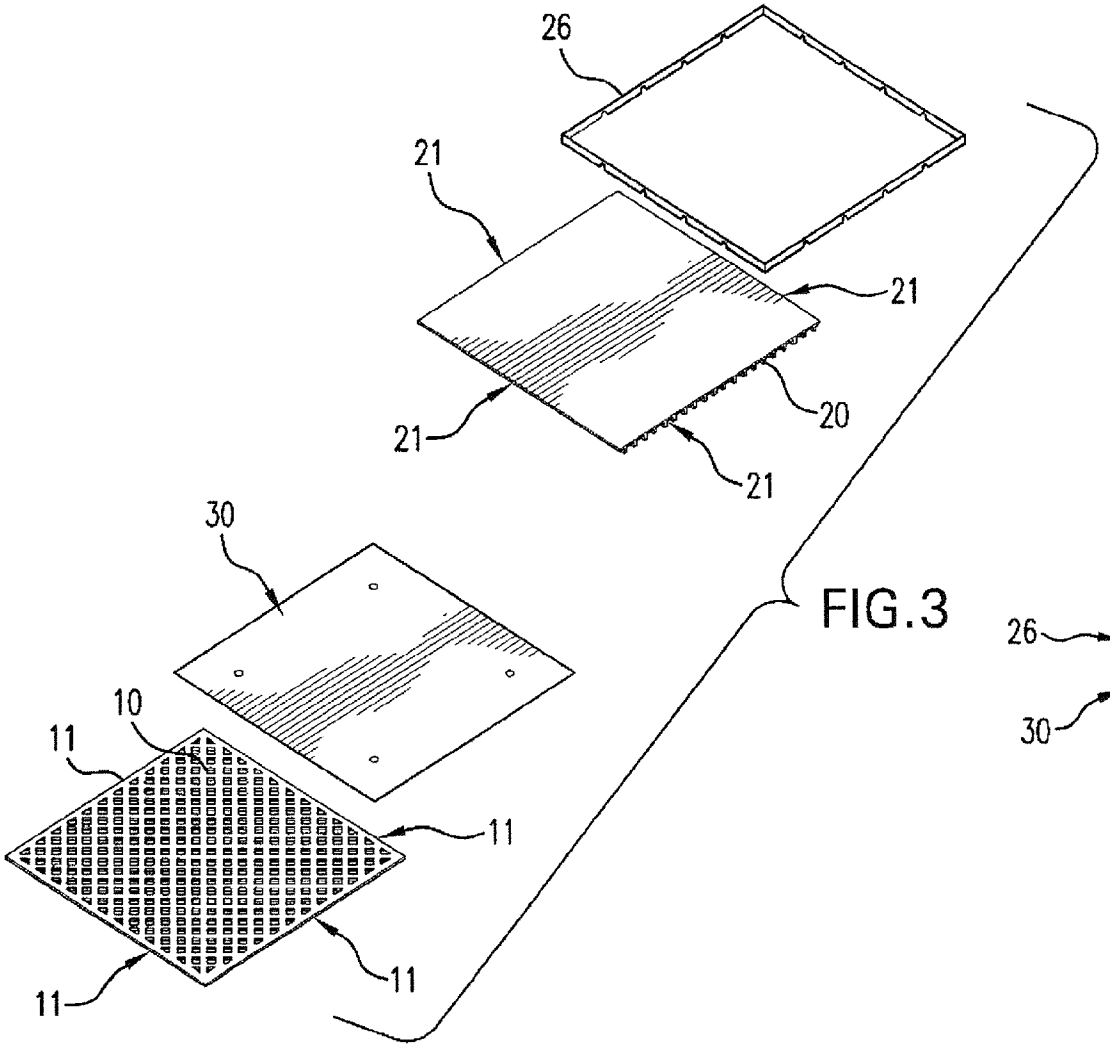
FIG. 3 is an exploded view of the individual floor section shown in FIG. 2.
Figure 4:
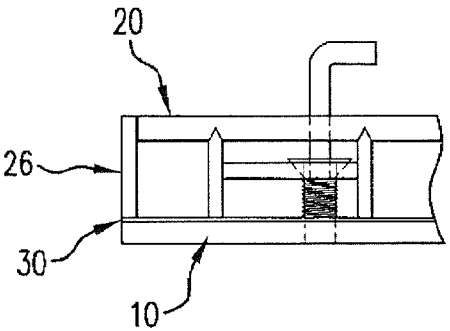
FIG. 4 is a cross-sectional view of the individual floor section shown in FIG. 2.

As shown in FIG. 1, the system generally includes a modular entrance floor system 1000 comprising a plurality of floor sections 100 (only one of which being labeled in FIG. 1) disposed adjacent each other. While the embodiment illustrated in FIG. 1 depicts each floor section 100 positioned so as to be in contact with adjacent floor sections, the floor sections 100 can be arranged such that adjacent floor sections 100 are spaced from each other and do not abut or otherwise engage each other, if so desired. As shown in FIGS. 2-4 each floor section 100 includes a base plate 10 having opposing surfaces defining a peripheral edge 11, and a surface plate 20 having opposing surfaces defining a peripheral edge 21. The surface plate 20 is removably attached to the base 10 and includes a plurality of drain features, as discussed in further detail below.

Figure 11:
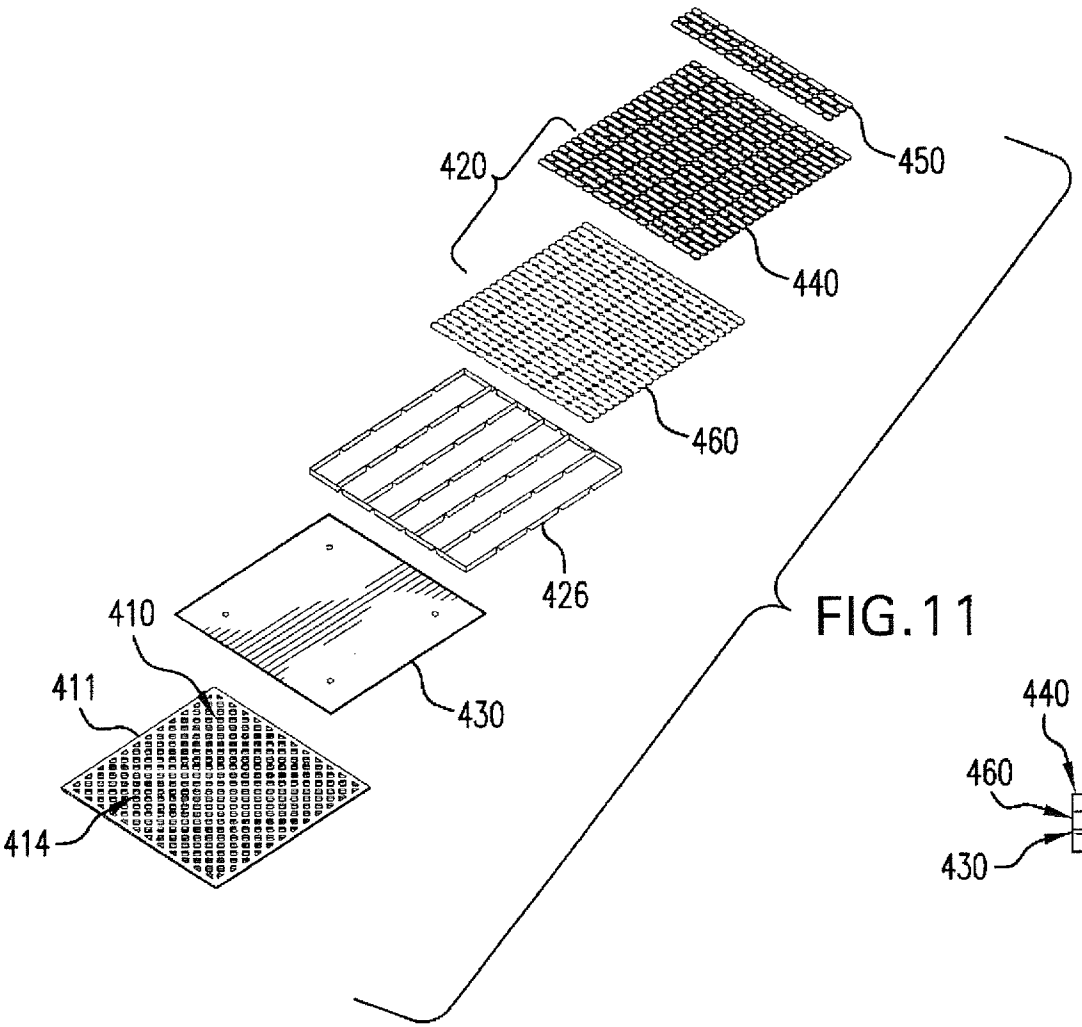
FIG. 11 is an exploded view of the individual floor section shown in FIG. 10.
Figure 12:
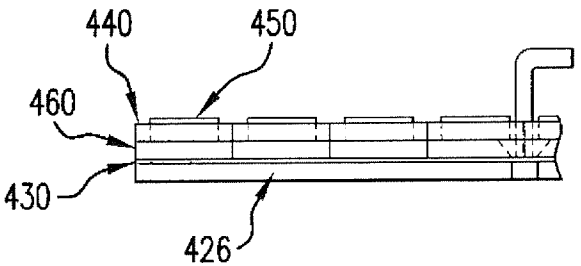
FIG. 12 is a cross-sectional view of the individual floor section shown in FIG. 10.

In accordance with another aspect of the disclosed subject matter, the peripheral edge 21 of the surface plate 20 can be offset or recessed from the peripheral edge 11 of the base plate 10, when in the attached configuration and as shown in FIG. 4. Further, this space between the two peripheral edges can be configured to receive the downwardly extending wall 26, described in further detail below. Alternatively, the peripheral edge 421 of the surface plate 420 can be configured to substantially coincide with the peripheral edge 411 of the base plate 410, when in the attached configuration and as shown in FIGS. 11-12. In other words, the base plate 10 and surface plate 20 are formed with the same dimensions such that the peripheral edges 11, 21 are vertically aligned when the surface plate 20 is attached to the base plate 10. Additionally, each floor section 100 is modular or independent with respect to other floor sections comprising the entrance floor area 1000. Further, each floor section 100 can be free from connection to an adjacent floor section. Accordingly, the surface plate 20 of a first floor section is interchangeable with the surface plate of a second floor section.

This modular configuration allows for rapid removal and replacement of a surface plate 20 of a select floor section 100, without removing or otherwise interfering with either the base plate 10 or surface plate 20 of an adjacent floor section. Likewise, such a modular configuration allows for a surface plate 20 of a select floor section 100 located a distance from the edge of the entrance floor area 1000, e.g., a floor section 101 in FIG. 1 located at or near the center of the entrance floor area, to be accessed and removed without removing or otherwise interfering with either the base plate 10 or surface plate 20 of any other floor sections 100 in the entrance floor area.

In accordance with yet another aspect of the invention, it is possible to remove and replace only those surface plates 20 of the floor sections located in the high pedestrian traffic areas, e.g., the portion of the floor which is aligned with an entrance doorway, which are prone to more frequent traffic and degradation. Consequently, and in contrast to prior art designs, the entire entrance floor area need not be replaced due to excessive wear over only a limited portion or narrow track. Instead, the worn surface plates 20 alone can be replaced, while the remainder of the entrance floor area remains intact thereby reducing maintenance time.

In accordance with still another aspect of the invention, the floor sections 100 are typically configured as polygonal modules which do not extend across the entire length or width of the entrance floor area 1000. In an exemplary embodiment, each floor section 100 is generally shaped as a square having sides of approximately 18 inches in length; however other sizes and shapes are considered to be within the scope of the invention. For example, each floor section 100 can be formed having a length of approximately 24 inches, or 36 inches, if so desired. This modular aspect and sizing of the floor sections allows for a single maintenance person to easily remove select surface plates 20 and access any debris received within the underlying base plate 10, without assistance of any additional maintenance staff or hoisting equipment. This reduces both the time associated with performing this maintenance, as well as the frequency in which maintenance need be performed.

Another feature of the modular entrance floor system disclosed herein is that each floor section can be provided with different and non-uniform surface plate 20 features which can provide a variety of aesthetic designs. Similarly, the modular aspect of the entrance floor system allows for floor sections having uniform surface plate designs to be rotated, e.g., 90° with respect to each other, to depict a patterned entrance floor area. In addition, multiple surface plate designs can be combined to depict a patterned entrance floor area.

As discussed above, each floor section 100 includes a surface plate which is removably attached to a base plate. In the exemplary embodiment depicted in FIGS. 1-4, the surface plate 20 is attached to the base plate 10 via mechanical fasteners such as set screws and self clinching nuts which are retained on the base plate 10. As illustrated in FIG. 4, the set screws are arranged below the surface plate 20 so as to be substantially "invisible" from the exterior of the surface plate if so desired, and remain accessible through the drain feature 24 in the surface plate 10, as discussed in further detail below.

The relative height or distance between the base plate 10 and surface plate 20 can be controlled by the fastening screw. In other words, as the screw is tightened, the surface plate 10 is attached downward towards the base plate 10. Accordingly, heights of select floor sections 100 can be altered relative to each other to accommodate an uneven floor surface across the entrance floor area. This can be useful for entrance floor installations in which the foundation has a grade or slope, such that individual floor sections of the modular entrance floor can be offset from each other to compensate or negate the effect of such a grade.

Figure 5A:
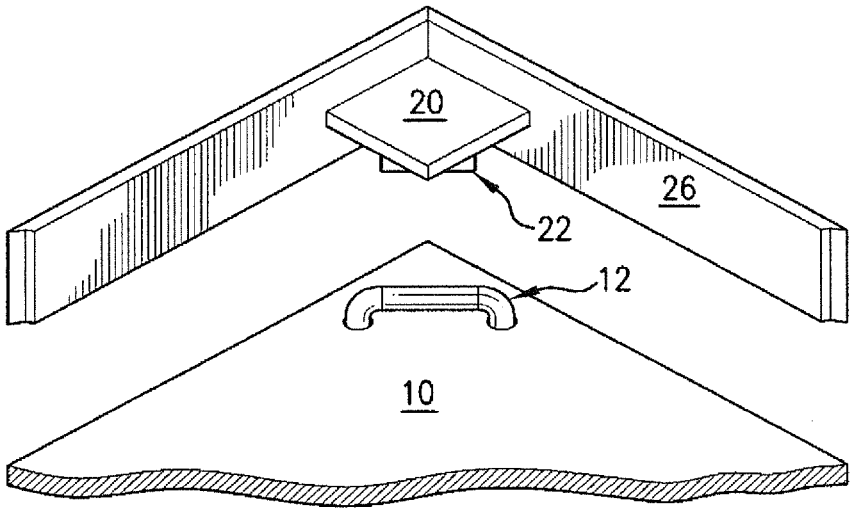
FIGS. 5A-B are an exploded view and perspective view, respectively, of a surface plate fastened to a base plate.
Figure 5B:
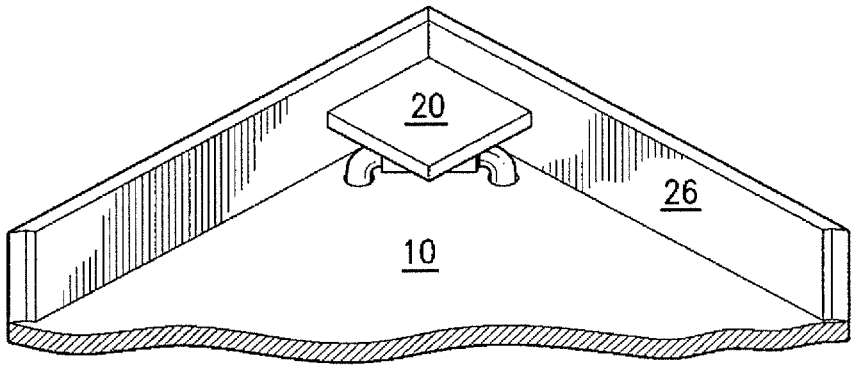

In addition, or alternative to the fastening screws described above, the surface plates can be removably attached to the base plates via any suitable fastening device including a tongue and groove interference or snap fit arrangement. As illustrated in FIGS. 5A-B, the base plate 10 can be provided with an attachment bar 12, and surface plate 20 can be provided with a corresponding latch 22 for matingly engaging the attachment bar 12. As shown, the fastening device can be positioned to allow for rotation of one surface plate with respect to another surface plate to provide various aesthetic designs, as discussed above. Additional fastening devices for attaching the surface plate 20 to the base plate 10 include hook and loop fasteners, gravity clips, locational studs, as well as non-mechanical fastening devices, e.g., magnets.

Further, each surface plate 20 can include a wall 26 which extends downwardly to define a gap between the surface plate 20 and base plate 10, when in the attached configuration. This gap serves as a reservoir or cavity for receiving debris and water from the surface plate 20. Additionally, this gap can provide sufficient clearance for various floor features such as cables or wiring, if so desired. In the embodiments illustrated in FIGS. 2-4, the wall 26 is disposed at the edges 21 and circumscribes the surface plate 20 and is supported by base plate 10; however alternative arrangements or positioning of the wall is considered to be within the scope of the disclosed subject matter. The wall 26 and surface plate 20 can be formed as separate and discrete elements, or alternatively, as a single-piece integrally formed member. A plurality of openings 25 can be formed within the downwardly extending wall 26 which serve as a drain allowing water or debris received within one floor section to move to another floor section. These openings 25 are beneficial in floor sections located in high traffic areas which receive a large amount of debris and water since they allow excess debris or water to dissipate or transfer to an adjacent floor section, thereby preventing build up of debris to the point where it exceeds the capacity of the gap and overflows back out of the drain feature 24.

While the surface plate 20 of the modular entrance floor system is removable, in the exemplary embodiment, the base plate 10 is permanently coupled to the foundation. However, a non-permanently coupled base plate is considered to be within the scope of the disclosed subject matter. The base plate 10 can be permanently coupled to the foundation with adhesives, epoxies, cement, or any other suitable bonding agent or system that provides a sufficient union to withstand the mechanical and thermal stresses exerted on the entrance floor area. Additionally, the base plate 10 can include a plurality of apertures 14 positioned uniformly, or in a discrete pattern, between edges 11. These apertures 14 increase the surface area in contact with the bonding agent thereby increasing bond strength, and further allow for the bonding agent to at least partially fill the void of the aperture so as to form a key-lock or mechanical bond in addition to the chemical bond provided by the bonding agent.

Also, a barrier sheet 30 can be provided between the base plate 10 and the surface plate 20. The barrier sheet 30 can be attached to the base plate 10 and serve to prevent any undesired seepage of the bonding agent through the apertures 14 and past the upper surface of the base plate. Further, the barrier sheet 30 can be formed of any non-porous material including, for purposes of illustration and not limitation, polymeric material, which can receive debris and water from the surface plate and retain the same to thereby prohibit seepage or degradation of the underlying bonding agent which joins the base plate 10 to the foundation.

The debris and water are allowed to pass through the surface plate 20 via a drain feature 24. This drain feature can be configured as a plurality of apertures in the surface plate. As shown in FIGS. 2-4, the surface plate 20 can be formed with a plurality of parallel rails extending between the edges of the surface plate. Alternatively, the plurality of rails can be arranged in a non-linear, intersecting, diverging or converging fashion as needed to depict various designs or indicia such as a logo, trademark, business name, or the like. Further customization can be achieved by altering select rails of a floor section such that a discrete pattern is depicted when a plurality of floor sections are positioned in the entrance floor area. For example, the elongate rails of floor section 100 in FIG. 2 can be cut to form a void in each rail. An additional material can then be inserted within that void such that the inserted rail extends in a different direction, e.g., diagonally across the floor section, if so desired.

Figure 6A:
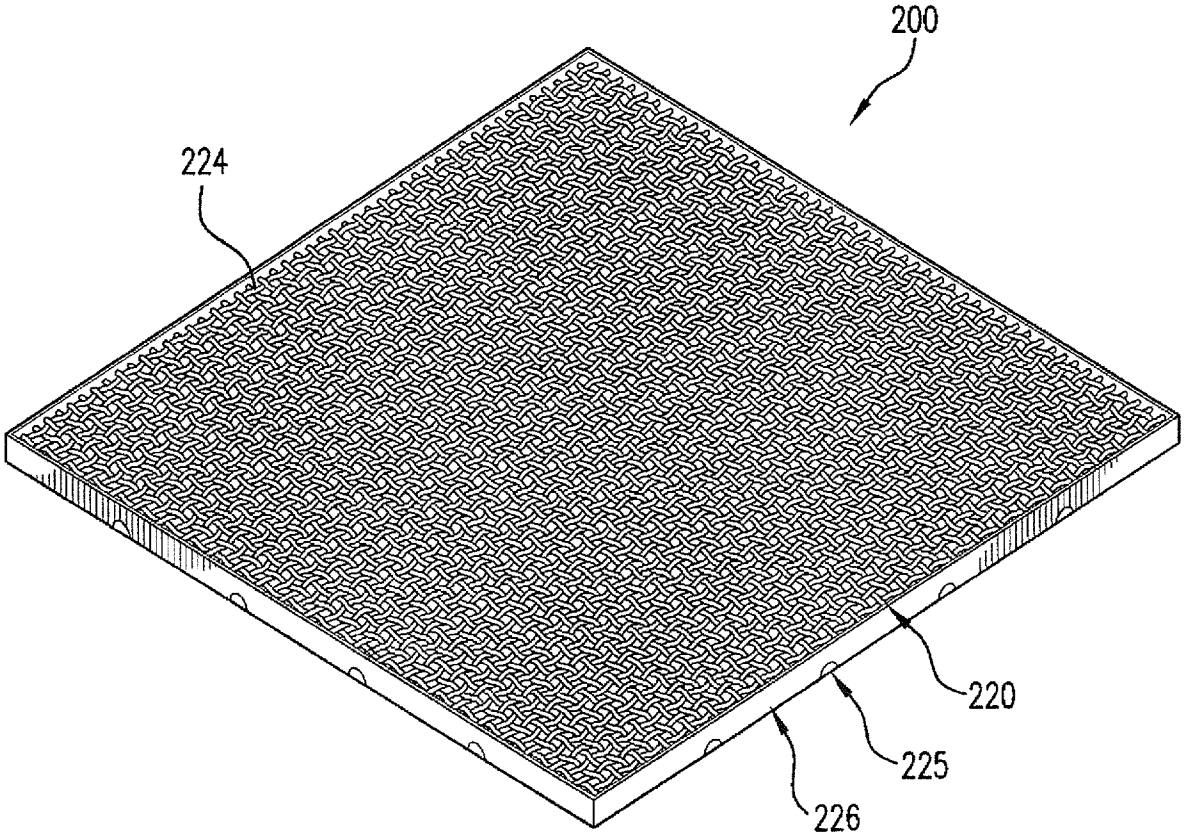
FIGS. 6A-B are perspective views of individual floor sections having alternative surface plate configurations.
Figure 6B:
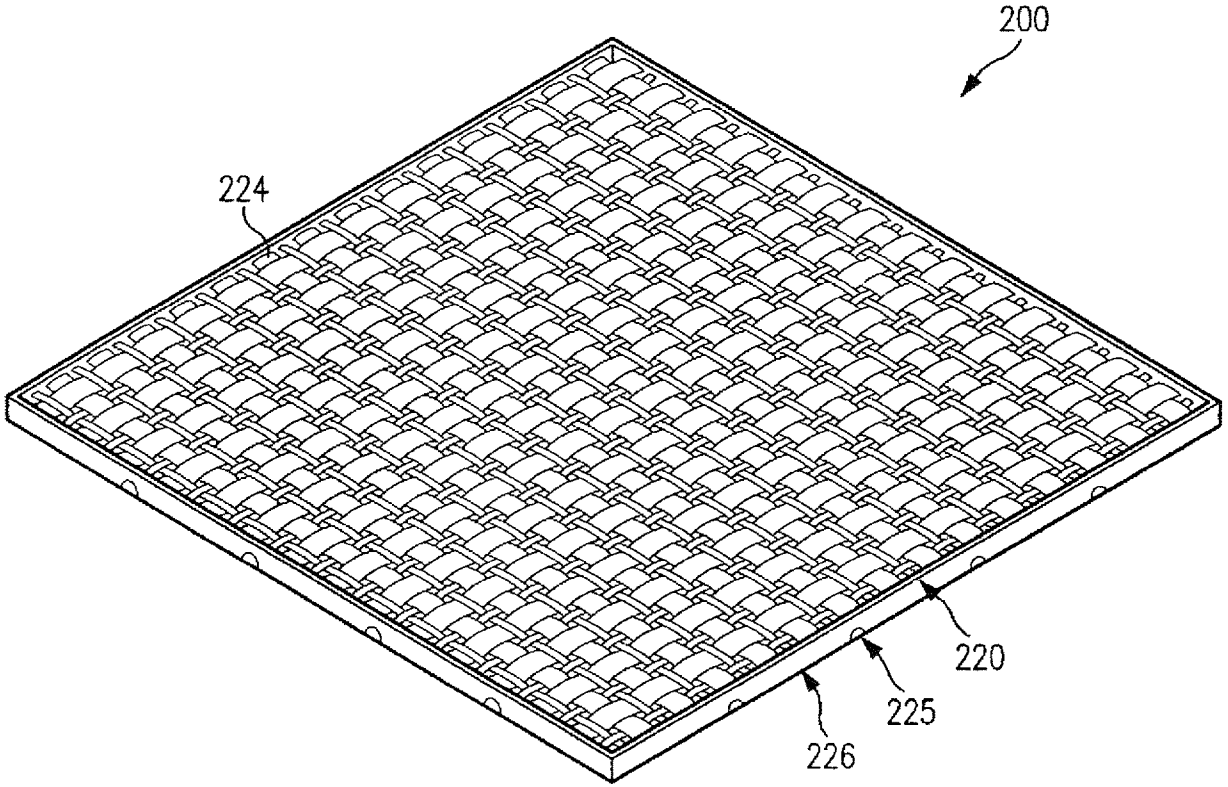
Figure 7:
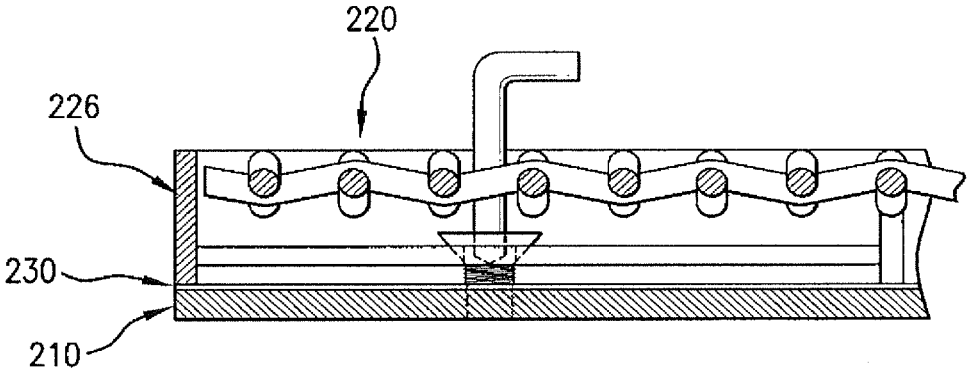
FIG. 7 is a cross-sectional view of the individual floor section shown in FIG. 6.

Additionally, and as shown in FIGS. 6-7, a floor section 200 is provided in which the rails of the surface plate 220 can be formed by a weave or pattern of undulating and perpendicular rails 224. A plurality of openings 225 can be formed within downwardly extending wall 226. In this embodiment, the undulating rails 224 have a repeating pattern of peaks and valleys such that a peak portion is positioned above a perpendicular rail, and a valley portion is positioned below a perpendicular rail, as best illustrated in FIG. 7. Further, alternating rails can have differing thicknesses and/or textures to provide even further aesthetic designs (as shown in FIG. 6B for the purpose of illustration and not limitation) and varying "fall through" areas, as discussed below. Further, the rail embodiments depicted in FIGS. 2-4 and 6-7 can be joined to a honeycomb structure which is positioned below the rails and reinforces the structural integrity of these embodiments. A barrier sheet 230 can be provided between a base plate 210 and the surface plate 220.

The spacing between adjacent rails defines drain apertures 24 which serve as a free or "fall through" area for allowing water and debris to pass through the surface plate 20 and be received by the base plate 10. In accordance with an aspect of the disclosed subject matter, the surface plate can be formed with approximately 9%-50% "fall-through" area, yet provide sufficient strength and rigidity to support a pedestrian. Moreover, each individual aperture is sufficiently small in size to provide adequate support for the soles of pedestrians. For example, each aperture 24 can be sized within a range of approximately 0.1 to 0.5 inches.

Figure 8:
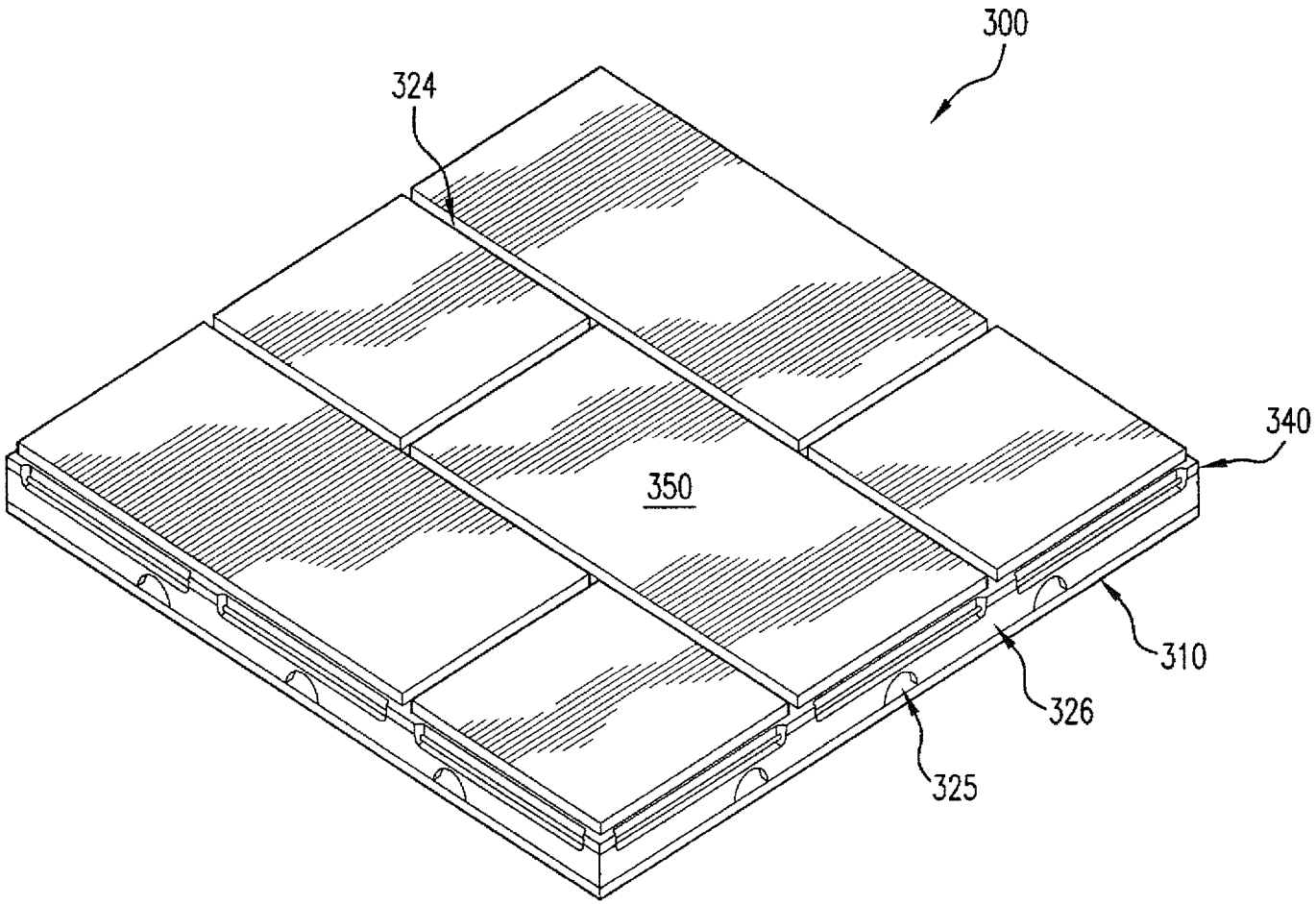
FIG. 8 is a perspective view of an individual floor section having yet another surface plate configuration.
Figure 9:
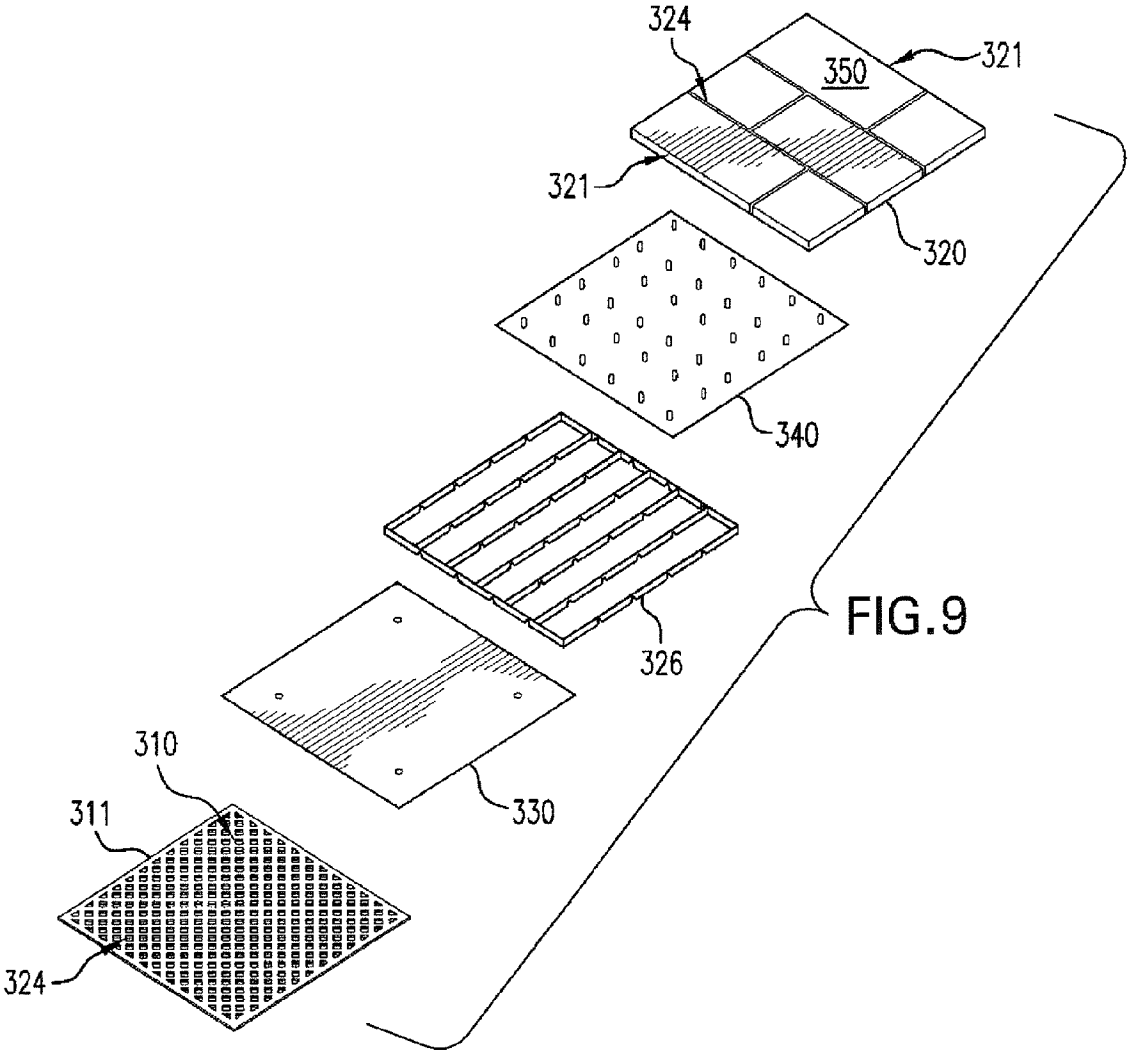
FIG. 9 is an exploded view of the individual floor section shown in FIG. 8.

In the exemplary embodiments illustrated in FIGS. 8-9 a floor section 300 is provided in which a surface plate 320 is configured to include a plurality of panels 350 of a flooring product, e.g., carpet, tile, or stone. This embodiment allows for a uniform and homogeneous appearance at the entrance of the building since the entrance floor area can be formed with the same building materials as the remaining floor area and/or interior wall panels. Accordingly, the entrance floor area is "invisible" to the pedestrian, yet retains the functionality of providing a stable and secure surface which removes and collects water or debris.

In this embodiment the floor section 300 can include an attachment plate 340 which is positioned between a barrier sheet 330 and surface plate 320, as depicted in FIG. 9. The attachment plate 340 can include a plurality of mechanical fasteners, e.g., studs, which are matingly received by the surface plate 320 to securely mount the surface plate thereto. The attachment plate 340 can be configured as a unitary sheet having apertures 344 therein and thus serve as a drain plate. Also, the drain feature 324 in this embodiment is configured as an elongated recess which can receive and channel debris and water from the surface plate 320. A plurality of openings 325 can be formed within downwardly extending wall 326. Additionally, a base plate 310 can include a plurality of apertures 314 positioned uniformly, or in a discrete pattern, between edges 311.

Figure 10:
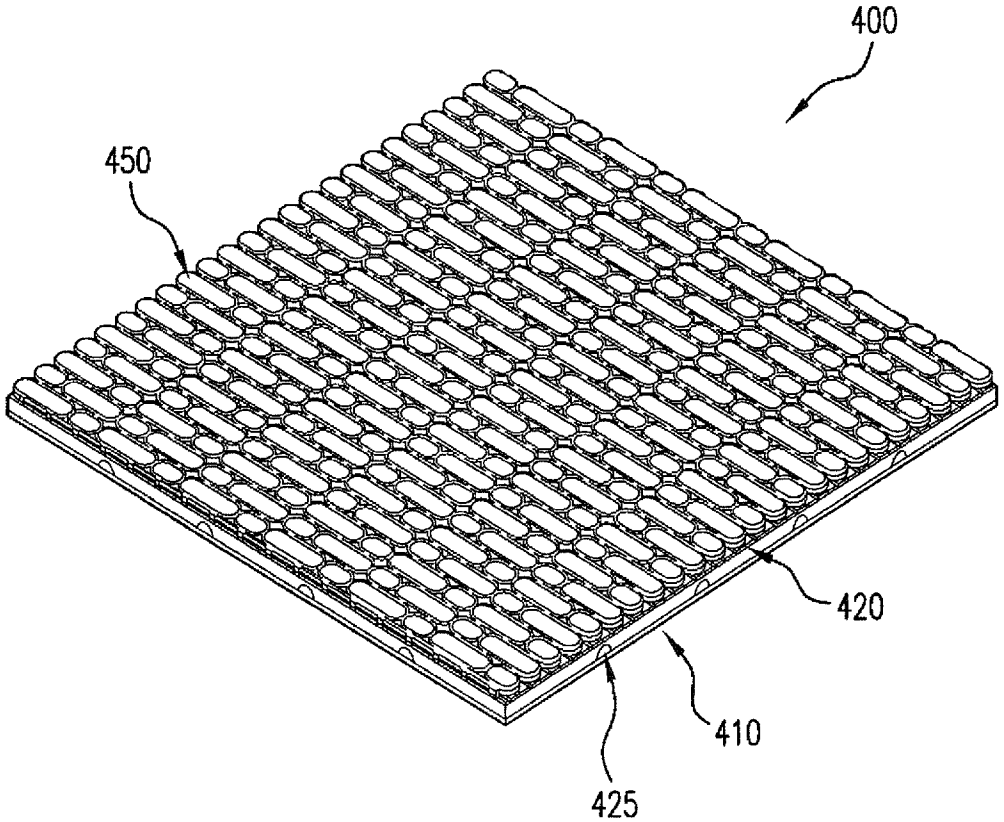
FIG. 10 is a perspective view of an individual floor section having still another surface plate configuration.

In the exemplary embodiments illustrated in FIGS. 10-11, a floor section 400 is provided in which a surface plate 420 is configured to include a drain plate 460 and a plurality of housings 440 attached to the top surface thereof. A plurality of openings 425 can be formed within downwardly extending wall 426. Additionally, a base plate 410 can include a plurality of apertures 414 positioned uniformly, or in a discrete pattern, between edges 411. The drain plate 460 and housings 440 can be formed as separate and discrete elements, or alternatively, as a single-piece integrally formed member. Each housing 440 is configured to receive an insert 450 which can be made of a variety of materials, e.g., carpet, rubber, glass, cork or resin, which provides a desired surface traction and/or appearance. The inserts 450 can be retained within the housing in a flush relationship with the surrounding housing 440, or alternatively can project above the housing 440 as shown in FIG. 12. While the presence of the housing 440 serves to enhance the strength of the floor section and prevent dislodgment of inserts 450, the inserts 450 can be also be attached directly to the drain plate 460 without the need for a housing 440. In this configuration, the inserts 450 can be provided with a male fastening member for a snap fit engagement with a corresponding female fastening member on the surface plate. Alternatively, the inserts can be adhesively bonded directly to the drain plate 460. Absent a housing 440, the inserts 450 serve as caps which project upwardly from the surface plate and provide the desired surface texture and/or appearance for the floor section.

The housings, if present, are spaced from each other to form voids or apertures therebetween. Likewise, the underlying surface plate 420 is provided with a pattern of apertures which coincide with the apertures between housings 450, if present. Accordingly, the alignment of apertures serves as a drain feature which allows for debris and water to pass from the pedestrian to the barrier sheet 430. The use of such housings 440 and inserts 450 allows for greater customization in that alternate housings 440 can retain inserts of varying material properties, size, and/or color. Further, the use of such housings 440 and inserts 450 allows for the inserts 450 to be readily removed, in addition to or instead of the surface plate 420, for thorough cleaning or replacement.

While the disclosed subject matter is described herein in terms of certain exemplary embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A modular entrance floor system comprising:

a plurality of floor sections, each floor section including:

a base plate having opposing first and second surfaces and first and second sides defining a width of the base plate; and a surface plate having a pattern of rails and having opposing first and second surfaces and first and second sides defining a width of the surface plate, the surface plate being removably attached to the base plate and having at least one drain feature;

wherein the width of the surface plate is substantially equal to or less than the width of the base plate; and at least one downwardly extending wall defining a gap between the surface plate and the base plate, wherein the at least one wall includes at least one opening formed therein, wherein the plurality of floor sections are configured such that the surface plate of a first floor section is interchangeable with the surface plate of a second floor section.

2. The modular entrance floor system of claim 1, wherein the pattern comprises a weave of undulating rails.

3. The modular entrance floor system of claim 1, further comprising additional material inserted in a void in the pattern of rails.

4. The modular entrance floor system of claim 1, wherein the width of the surface plate comprises 9 inches.

5. The modular entrance floor system of claim 1, wherein the first surface of the base plate is coupled to a foundation.

6. The modular entrance floor system of claim 1, wherein the second surface of the base plate includes a fastening device to attach the surface plate with the base plate.

7. A modular entrance floor system comprising:

a plurality of floor sections, each floor section including:

a base plate having opposing first and second surfaces and first and second sides defining a width of the base plate, wherein the base plate has a plurality of apertures extending between the first and second surfaces; and a surface plate having a pattern of rails and having opposing first and second surfaces and first and second sides defining a width of the surface plate, the surface plate being removably attached to the base plate and having at least one drain feature, the base plate further comprising a barrier sheet disposed on the second surface of the base plate adjacent the surface plate, wherein the width of the surface plate is substantially equal to or less than the width of the base plate; and wherein the plurality of floor sections are configured such that the surface plate of a first floor section is interchangeable with the surface plate of a second floor section.

8. The modular entrance floor system of claim 1, wherein each surface plate is removable from its base plate independent of adjacent surface plates.

9. The modular entrance floor system of claim 1, wherein the base plate is configured to receive at least one of water and debris from the drain feature.

10. The modular entrance floor system of claim 1, wherein the drain feature is an aperture.

11. The modular entrance floor system of claim 1, wherein the drain feature is an elongated recess.

12. The modular entrance floor system of claim 1, wherein the surface plate further comprises at least one housing configured to receive at least one insert.

13. The modular entrance floor system of claim 1, wherein the surface plate further comprises at least one cap attached thereto.

14. The modular entrance floor system of claim 7, wherein the at least one drain feature comprises approximately 9 percent to approximately 50 percent of a surface area of the removable surface plate.

15. The modular entrance floor system of claim 6, wherein the fastening device includes at least one of a tongue and groove interference, a snap fit arrangement, an attachment bar and latch, a hook and loop fastener, a gravity clip, a locational stud, and a magnet.

16. The modular entrance floor system of claim 1, wherein the at least one drain feature comprises approximately 9 percent to approximately 50 percent of a surface area of the removable surface plate.

17. The modular entrance floor system of claim 14, wherein the surface plate further comprises at least one housing configured to receive at least one insert.

18. The modular entrance floor system of claim 7, wherein the first surface of the base plate is coupled to a foundation.

19. The modular entrance floor system of claim 7, wherein each surface plate is removable from its base plate independent of adjacent surface plates.

20. The modular entrance floor system of claim 7, wherein the drain feature is at least one of an elongated recess and an aperture.

21. The modular entrance floor system of claim 7, wherein the surface plate further comprises at least one housing configured to receive at least one insert.

22. The modular entrance floor system of claim 7, wherein the surface plate further comprises at least one cap attached thereto.

* * * * *